United States Patent [19]

Veluz

[11] Patent Number: 4,747,418

[45] Date of Patent: May 31, 1988

[54] CIGARETTE FILTER UNIT

[75] Inventor: Serge Veluz, Echichens, Switzerland

[73] Assignee: Baumgartner Papiers S.A., Switzerland

[21] Appl. No.: 899,472

[22] Filed: Aug. 22, 1986

[30] Foreign Application Priority Data

Aug. 26, 1985 [CH] Switzerland ..... 3664/85

[51] Int. Cl.[4] ..... A24D 3/04

[52] U.S. Cl. ..... 131/331; 131/336; 131/339; 131/344

[58] Field of Search ..... 131/331, 336, 339, 340, 131/344

[56] References Cited

U.S. PATENT DOCUMENTS

| | | | |
|---|---|---|---|
| 3,394,707 | 7/1968 | Ellis | 131/344 |
| 3,496,945 | 2/1970 | Tomkin | 131/336 |
| 3,503,406 | 3/1970 | Riegel et al. | 131/336 |

*Primary Examiner*—V. Millin

*Attorney, Agent, or Firm*—Watts, Hoffman, Fisher & Heinke

[57] ABSTRACT

In order to obtain, during the smoking of a cigarette, each time the smoker draws, an amount of condensate which is more constant or is even less than heretofore, there is provided a cigarette filter unit having at least one membrane in the form of a screen positioned across the smoke-gas flow paths, the unit acting, while the cigarette is being smoked, as an internal bypass element. To this end, the spatial distribution of the openings in the membrane, and the cross sectional areas thereof, are accurately determined as to the size and shape. The thickness of the membrane is between 10 and 150 μm, the number of openings therein is between 500 and 25,000, and the cross sectional area of the openings is between 80 and 3,000 $\mu m^2$. Furthermore, an additional element providing at least one flow aperture whose cross section is at least 10 times larger than that of the largest opening in the membrane and/or the ventilating openings, is provided after the membrane, as seen in the direction of flow, extending between the interior and the exterior of the filter unit.

17 Claims, 6 Drawing Sheets

CIGARETTE FILTER UNIT

This invention relates to a cigarette filter unit.

During the smoking of a cigarette without a cigarette filter, with or without ventilation, and/or with a conventional cigarette filter, the amount of condensate in the smoke entering the smoker's mouth through the suction end of the cigarette, as he smokes, increases relatively sharply, which is undesirable.

It is the purpose of the present invention to provide a cigarette filter unit which, in combination with a portion of tobacco secured to it, does not exhibit these disadvantages when the tobacco is smoked, or exhibits them only to a much smaller degree; in other words, with the aid of the filter, a constant or even a decreasing amount of condensate is obtained each time the smoker draws on the filter cigarette.

In order to accomplish this purpose, the cigarette filter unit is designed, according to the invention, in such a manner that it comprises at least one membrane which is in the form of a screen and is arranged in a smoke-gas flow cross section, the spatial distribution and cross sectional areas of the openings in the membrane being accurately determined as to size and shape; that the thickness of the said membrane is between 10 and 150 $\mu$m, the number of openings in the membrane is between 500 and 25,000, and the cross sectional area of these openings is between 80 and 3,000 $\mu m^2$; and that an additional smoke-gas flow cross section, having at least one flow aperture the cross section of which is at least 10 times larger than that of the largest opening in the membrane, and/or ventilating openings are provided after the membrane, as seen in the direction of flow, extending between the interior and the exterior of the filter unit.

In this connection it is desirable for the thickness of the membrane to be between 30 and 100 $\mu$m and for the individual, screen like openings in the membrane to be between 100 and 2,500, preferably between 100 and 1,800 $\mu m^2$.

Since the materials from which the membrane can be made must comply with the laws applicable to the tobacco industry, it is desirable for the said membrane to be made of natural textile and/or synthetic fibres, or of a perforated foil.

In order to achieve, as far as possible, the same amount of condensate each time the smoker draws on the cigarette, it is desirable for the number of ventilating holes provided, and for the cross section thereof, to be such that an initial dilution with ventilating air of between 30 and 70, preferably between 45 and 55% is obtained.

In order to ensure that a cigarette equipped with the filter unit according to the invention has smoking properties which are pleasant to the smoker, it is also desirable for the number of passages provided in the membrane, and the cross sectional areas thereof, to be matched in such a manner as to ensure that when 17.5 ml/s of air are drawn from the suction end of the filter unit, the latter causes a pressure drop of between 25 and 150 mm water-head.

In order to avoid unduly sharp variations in filter characteristics, it is desirable for the distance between individual openings in the membrane and the magnitude of the cross sectional areas of these openings to vary by less than 10% from the predetermined value.

In order to achieve special filter characteristics it may be advantageous for the membrane to comprise passages of different cross sectional areas, the size and distribution of which are accurately determined.

It may be desirable for the internal cross section of the filter unit to be provided, at the location of the membrane, with a dividing and bearing partition wall extending to the said membrane, connected thereto, and consisting of a material at least approximately impermeable to gas.

In order to obtain a bypass flow, it is desirable for the dividing and bearing wall, and/or the membrane, to be provided with one or more excess flow openings, the individual cross sectional areas of which exceed $10^4$ $\mu m^2$.

It may also be advantageous for the membrane to be arranged in the flow cross section of a small tube made of a mterial which is at least approximately impermeable to gas, the remaining cross section between the outside of the said tube and the outside of the filter unit being filled, at least over a part of the length of the said tube, with a tobacco smoke filtering material. In this connection, it is desirable for the small tube, serving to form two flow channels separated from each other, to have its interior filled, at least over a part of its length, with filter material in the form of granules and/or fibres.

It may also be desirable for a filter element, altering the composition of the tobacco smoke, to be arranged as seen in the direction of flow, before and/or after the membrane, in the flow cross section of the filter unit.

The invention will now be described, by way of example, with reference to the accompanying drawings, in which.

In all of the examples described hereinafter, similar parts are denoted by the same reference numerals.

Figure 1:
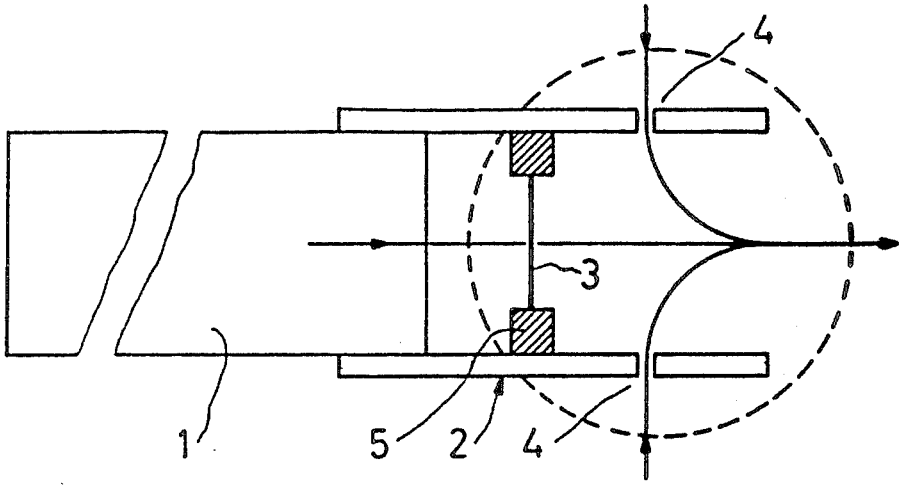
FIG. 1 is a diagrammatic longitudinal section of a first example of a cigarette filter unit according to the invention, secured to a portion of tobacco.

As will be seen from FIG. 1, a cigarette filter unit 2, secured in the usual manner to a portion 1 of tobacco by means of a so-called tipping paper, comprises a screen like membrane 3 arranged in the smoke-gas flow path. In order to obtain accurately reproducible results, the spatial distribution of the openings in the membrane, over the entire surface thereof, and the cross sectional areas of these openings, are accurately predetermined as to size and shape. Moreover the membrane is made of a fabric consisting of synthetic fibres, e.g. polymer fibres.

The membrane 3, arranged in the filter unit 2, is not designed to filter aerosols out of a flow of smoke-gas passing through it. Although the filtration capacity of the membrane, in respect of the particle phase of the smoke-gas mixture flowing therethrough, is measurable, in practice it is so small as to be negligible.

The membrane 3 is therefore not intended to act as a filter element, but as a bypass element. To this end, the membrane must be very thin, so that it provides a relatively small initial flow resistance. The action of the membrane in the filter unit 2 is such that, when a smoke-gas aerosol passes through it, very few of the aerosol particles adhere to it, but these particles are sufficient to cause a noticeable reduction in the free cross sections of the membrane openings, and thus to bring about a sharp increase in the flow resistance set up by the membrane thus charged. To this end, the thickness of membrane 3 is between 30 and 100 $\mu$m, the number of openings in the membrane is between 500 and 25,000, and the cross section of the individual openings in the membrane is between 100 and 2,5000 $\mu m^2$.

In order to ensure that accurately reproducible characteristics are obtained when such cigarette filter units 2 are mass produced, the membrane must not be made of a material in which the spatial distribution of the smoke-gas passages, the cross sections of the passages, and the shapes of the cross sections, are haphazard.

It has therefore been found desirable for the distance between individual openings in the membrane, and the size of the cross sectional areas of these openings, to vary by less than 10% from a predetermined value.

As will also be seen from FIG. 1, ventilation openings 4, running between the interior and the exterior of filter unit 2, are provided after the membrane as seen in the direction of flow. The number and cross sections of the ventilation openings may be such as to produce an initial dilution of 50% in the tobacco smoke drawn from portion 1 of tobacco.

The internal cross section of the filter unit 2 is provided, at the location of the membrane, with a dividing and supporting partition wall 5 which is connected to the membrane and is made of a material which is at least impermeable or nearly impermeable to gas.

Now if a cigarette, equipped with a cigarette tip 2 as shown in FIG. 1, is smoked, the first time the smoker draws on the lighted cigarette the flow of tobacco smoke passes through it with a relatively small initial pressure drop brought about by the membrane 3, for example a pressure drop of 30 mm water-head. Aerosol particles in the tobacco smoke adhere to the membrane, the free cross sections of the individual openings in the membrane gradually becoming smaller, and the pressure drop caused by the membrane gradually becomes larger. Over the period of time during which the portion 1 of tobacco is smoked, the membrane 3 is increasingly blocked by smoke aerosol particles, while more air from the ventilation openings 4 is mixed with the smoke drawn in by the smoker. As a result of this, the concentration of tobacco smoke entering the filter unit 2, which increases as the portion 1 of tobacco becomes shorter, is again increasingly diluted with air, because of the action of the membrane. In contrast to what has happened in the past therefore, the concentration of smoke, entering each time the smoker draws on the cigarette, can be kept constant within relatively narrow limits and the aroma of the tobacco smoke drawn in by the smoker remains practically unchanged while the whole of the portion 1 of tobacco is smoked.

Figure 2:
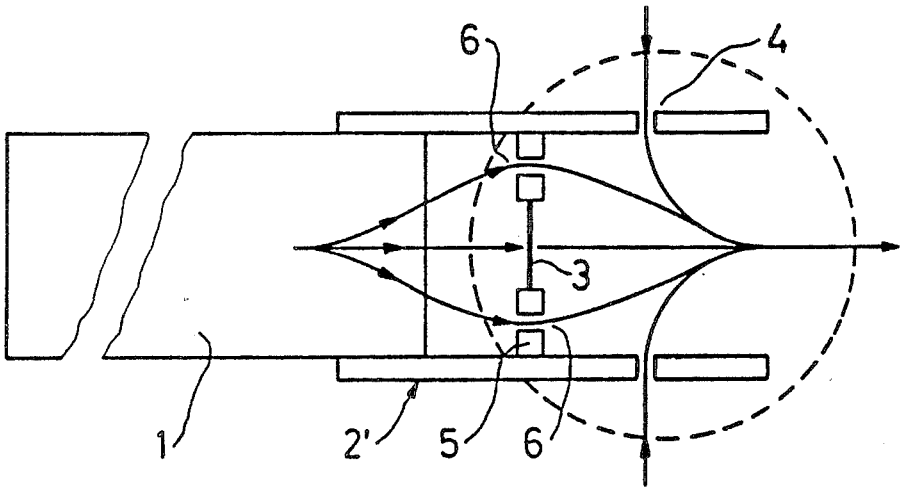
FIG. 2 is a diagrammatic longitudinal section of a second example of a cigarette filter unit according to the invention, secured to a portion of tobacco.

FIG. 2 shows a second example of a cigarette filter unit 2' secured to a portion 1 of tobacco.

In this example, in contrast to FIG. 1, a dividing and supporting parition wall 5 is provided with a plurality of excess flow openings 6 in order to obtain a smoke-gas bypass. The cross sections of these openings however are much larger than those of the membrane openings, and may be at least ten times larger. A design of this kind allows a flow of smoke-gas mixture to be maintained even when the membrane 3 is almost or entirely blocked, restricting the maximal possible operating suction resistance to a relatively accurately predeterminable value.

As regards dilution of the tobacco smoke flowing through the filter, the operation of filter unit 2' shown in FIG. 2, is otherwise similar to that of FIG. 1.

Figure 3:
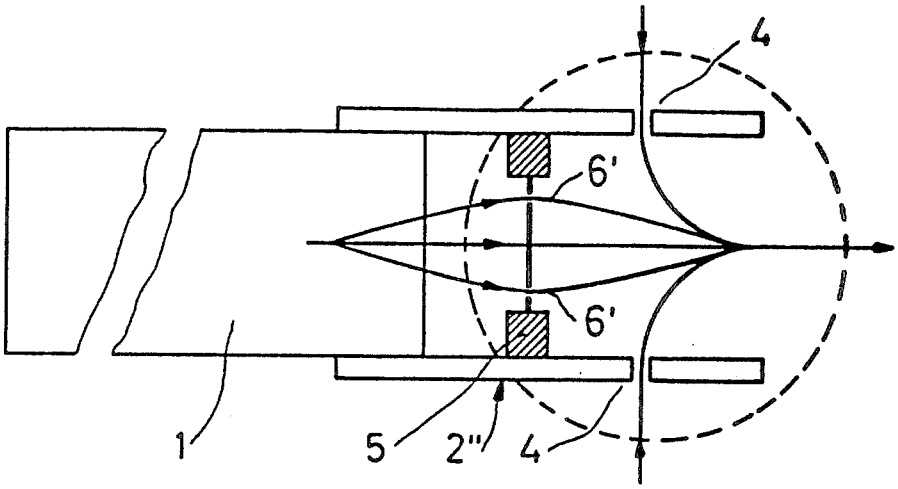
FIG. 3 is a diagrammatic longitudinal section of a third example of a cigarette filter unit according to the invention, secured to a portion of tobacco.

FIG. 3 shows a third example of a cigarette filter unit 2" secured to a portion 1 of tobacco. The filter unit 2" has ventilation openings 4 of the type shown in the second example illustrated in FIG. 2.

In the case of the example illustrated in FIG. 3, and in contrast to the example illustrated in FIG. 2, the excess flow openings 6 are provided, not in the dividing and supporting wall 5 holding the membrane 3, but in the membrane in the form of additional perforations therein.

Figure 4:
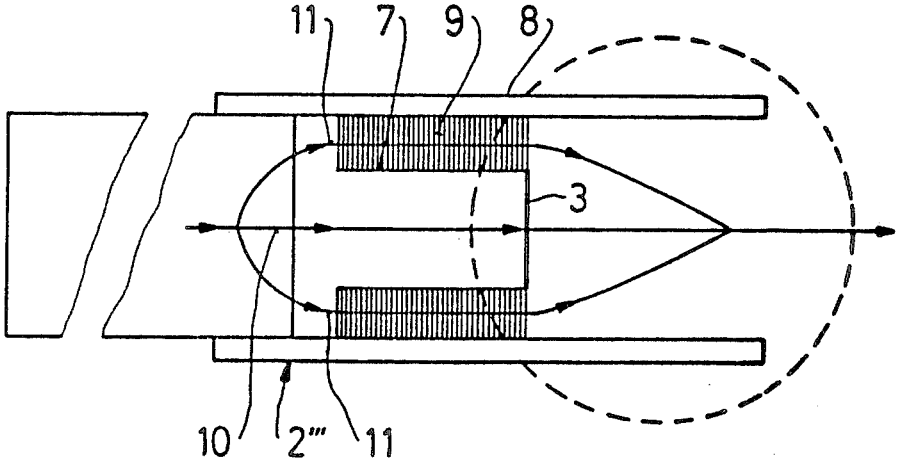
FIG. 4 is a diagrammatic longitudinal section of a fourth example of a cigarette filter unit according to the invention, secured to a portion of tobacco.

In the embodiment illustrated in FIG. 4, for the purpose of obtaining two separate internal flow channels 10 and 11, the membrane 3 is arranged in the flow cross section of a small tube 7 made of a material which is practically impermeable to gas, the remaining flow cross section, forming the second flow channel 11 being filled, between the outside of the tube 7 and the inside of the outer casing of the filter unit 2''', with filter material 9 which filters the tobacco smoke flowing through it.

In this case, the tobacco smoke initially passes unfiltered through the first flow channel 10 and through the membrane 3 into the smoker's mouth.

As smoking time increases, the flow resistance of the membrane 3 increases, as described hereinbefore, and the tobacco smoke, now flowing from the portion 1 of tobacco, is thus guided increasingly through the second flow channel 11, through the filter material 9 which filters the tobacco smoke flowing through it. Thus with a filter unit 2''' of this design, the concentration of the different smoke-gas components, and thus the aroma appreciated by the smoker while smoking the whole of portion 1 of tobacco, can be kept relatively constant, and the suction resistance observed by the smoker does not vary appreciably or unpleasantly.

Figure 5:
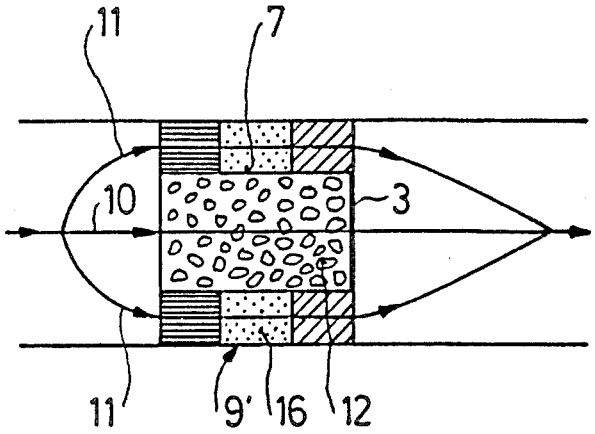
FIG. 5 is a diagrammatic longitudinal section of a fifth example of a cigarette filter unit according to the invention, secured to a portion of tobacco.

In the embodiment illustrated in FIG. 5, and in contrast to that shown in FIG. 4, the interior of the small tube 7, forming the first flow channel 10, is filled with a granular material 12 which may also be charged with an aromatic substance. Arranged on the outside of the tube 7, in the second flow channel 11 in chamber filter 9', an annular chamber 16 for the accommodation of a freely flowing filter and/or aroma carrier material is formed between a circular cellulose and a circular acetate plug.

The increasing bypassing of the flow, effected by the membrane 3 as the portion 1 of tobacco is consumed, through second flow channel 11 is similar to that of the example of FIG. 4.

With a filter unit of this kind it is possible to filter the through flow of tobacco smoke differentially throughout the whole smoking period and/or to enrich it with an aroma since, in the initial phase of smoking, almost all of the tobacco flows only through the first flow channel 10 and thereafter increasingly through the second flow channel 11.

Figure 6:
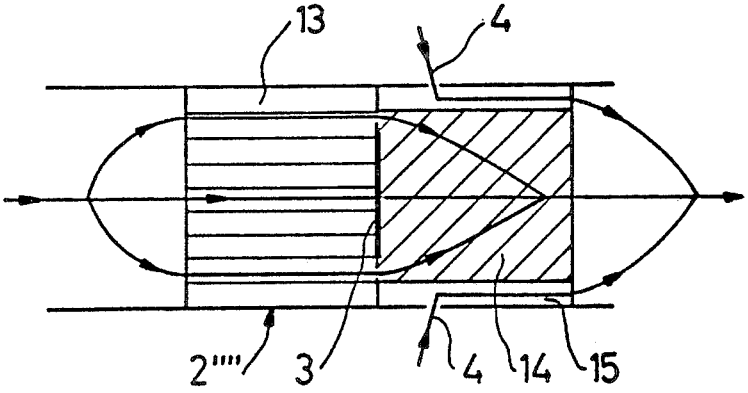
FIG. 6 is a digrammatic longitudinal section of another example of a cigarette filter unit according to the invention, secured to a portion of tobacco.

In the embodiment illustrated in FIG. 6, and in contrast to the example shown in FIG. 1, a cellulose or acetate filter plug 13 or 14 is arranged before and after the membrane 3, as seen in the direction of flow, in the flow cross section of the filter unit 2'''', this being in the manner of a conventional dual filter.

The flow resistance produced with increased smoking of the portion 1 of tobacco, and with increasing blocking of the membrane 3, results in an increasing amount of ventilating air being drawn by the smoker through ventilation openings 4, and this air dilutes the smoke and passes to the smoker's mouth through channels 15.

Figure 7:
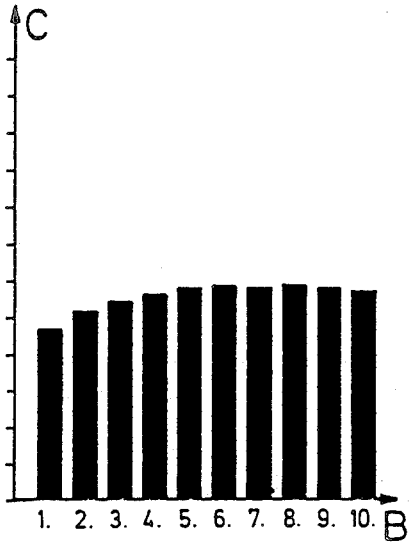
FIG. 7 is a diagram showing the amount C of condensate per draw B in an arrangement according to FIG. 1.
Figure 8:
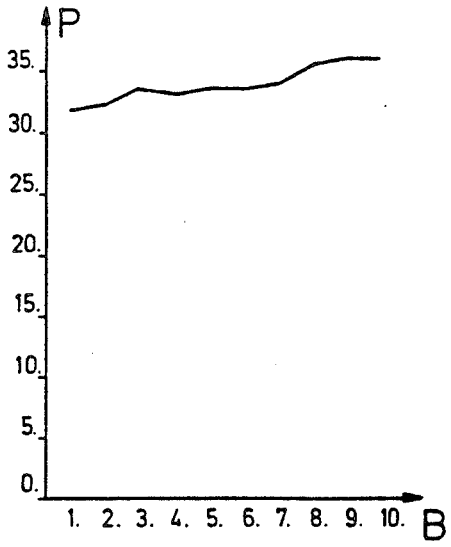
FIG. 8 is a diagram showing the pressure drop P, in mm water-head, associated with the diagram shown in FIG. 7.

FIGS. 7 and 8 illustrate the amount of condensate C per draw B of the smoker (FIG. 7), and the pressure drop P associated therewith, during the smoking of a filter cigarette according to FIG. 1. the membrane used in this connection contained 990 openings, the cross section of the individual membrane openings amounted to 1,680 $\mu m^2$, and the initial degree of dilution of the lighted cigarette was 50%.

As will be seen from FIG. 7, the amount of condensate drawn by the smoker, each time he draws on the suction end of filter unit 2, fluctuates only within relatively narrow limits from the first to the last draw, and the change in pressure drop (see FIG. 8) observed by the smoker is also relatively modest.

Figure 9:
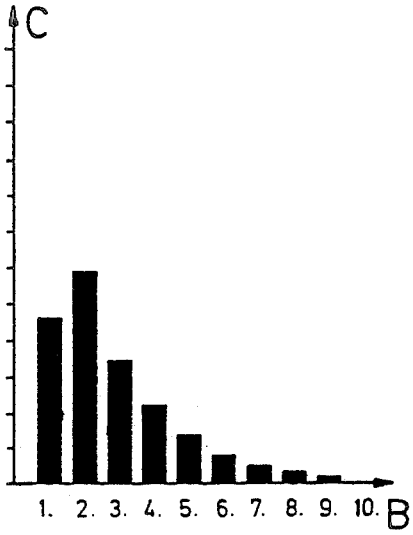
FIGS. 9 and 10 show possible patterns of amounts C of condensate per draw B, using other possible examples of cigarette filter units according to the invention.
Figure 10:
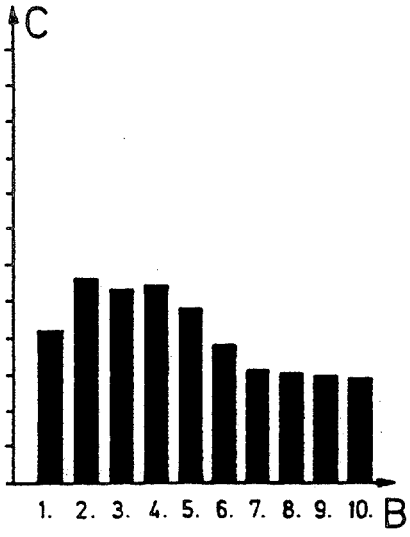

As shown in FIGS. 9 and 10, and in complete contrast to cigarettes already on the market, it is also possible to produce a cigarette tip according to the invention resulting in a smoking characteristic according to which, after an initial increase in the condensate content per draw, the said content decreases as smoking is continued (FIG. 9), or the said content decreases and thereafter remains approximately constant (FIG. 10).

Figure 11:
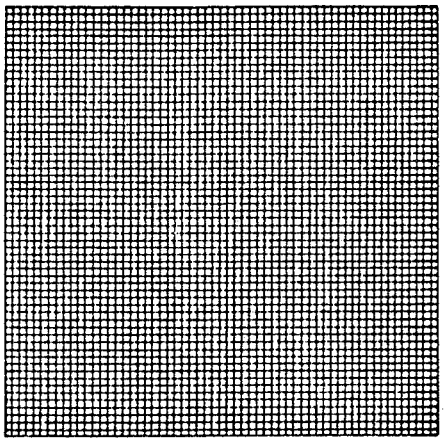
FIGS. 11, 12 and 13 show different possible membrane structures.
Figure 12:
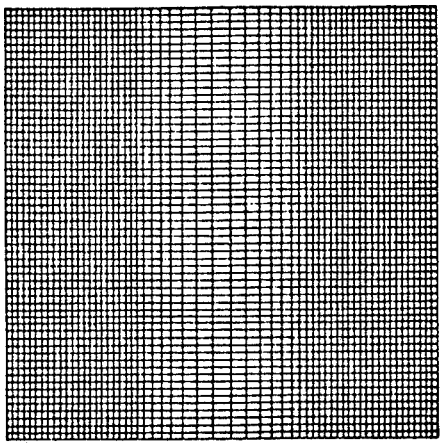
Figure 13:
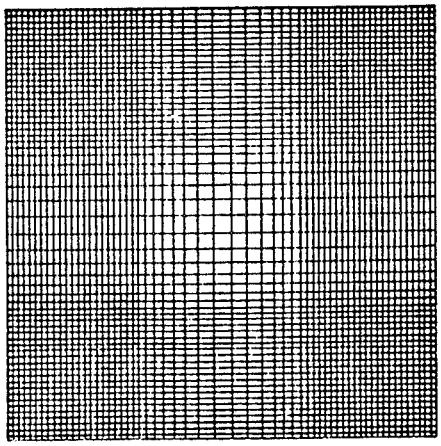

FIGS. 11, 12 and 13 show membrane screens which differ in principle.

In the case of the screen in FIG. 11, the geometrical distribution of the openings, and the cross sections thereof, are completely uniform.

In the case of the screens shown in FIGS. 12 and 13, the geometrical distribution of the openings and the cross sections thereof vary, not at random but according to an accurately predetermined distribution arrangement.

It is to be understood that other designs of screens are also conceivable.

I claim:

1. A cigarette filter unit, comprising at least one membrane which is in the form of a screen and is arranged in the smoke-gas flow cross section, the spatial distribution and cross sectional areas of the openings in the membrane being accurately determined as to size and shape, wherein the thickness of the membrane is between 10 and 150 $\mu m$, the number of openings in the membrane is between 500 and 25,000, and the cross sectional area of these openings is between 80 and 3,000 $\mu m_2$.

2. A filter unit according to claim 1, characterized in that the thickness of the membrane is between 30 and 100 $\mu m$ while the cross sectional area of the individual, screen like openings provided in the membrane is between 100 and 2,500 $\mu m^2$, preferably between 100 and 1,800 $\mu m^2$.

3. A filter unit according to claim 1, characterized in that the membrane is made of natural textile and/or synthetic fibres, preferably in the form of a fabric, or consists of a perforated foil.

4. A filter unit according to claim 1, characterized in that the number of passages provided in the membrane, and the cross sectional areas thereof, are matched in such a manner as to ensure that when 17.5 ml/s of air are drawn from the suction end of the filter unit, the latter causes a pressure drop of between 25 and 150 mm water-head.

5. A filter unit according to claim 1, characterized in that the distance between individual openings in the membrane, and the magnitude of the cross sectional areas of these openings, does not vary by more than 10% from a predetermined value.

6. A filter unit according to claim 1, characterized in that the membrane comprises passages of different cross sectional areas, the size and distribution of which are accurately determined.

7. A filter unit according to claim 1, characterized in that the internal cross section thereof is provided, at the location of the membrane, with a dividing and supporting partition wall extending to the said membrane, connected thereto, and consisting of a material substantially impermeable to gas.

8. A filter unit according to claim 7, characterized in that the dividing and supporting partition wall has at least one excess flow opening whose cross section is at least 10 times larger than that of the largest opening in the membrane.

9. A filter unit according to Claim 8, characterized in that the excess flow opening has a cross sectional area of at least $10^4$ $\mu m^2$.

10. A filter unit according to claim 1, characterized in that the membrane is arranged in the flow cross section of a small tube made of a material which is substantially impermeable to gas, the remaining cross section, between the outside of the said tube and the outside of the filter unit being filled, at least over a part of the length of the said tube, with a tobacco smoke filtering material.

11. A filter unit according to claim 10, characterized in that said small tube defines two flow channels separated from one another, and has its interior filled, at least over a part of its length, with filter material in the form of granules and/or fibres.

12. A filter unit according to claim 1, characterized in that a filter element, altering the composition of tobacco smoked, is arranged, as seen in the direction of flow, before and/or after the membrane, in the flow cross section of the filter unit.

13. A filter unit according to claim 1, characterized in that the membrane has at least one excess flow opening whose cross section is at least 10 times larger than that of the largest opening in the membrane.

14. A filter unit according to claim 13, characterized in that the excess flow opening has a cross sectional area of at least $10^4$ $\mu m^2$.

15. A filter unit according to claim 1, characterized in that ventilation openings are provided after the membrane, in the direction of flow, extending between the interior and exterior of the filter unit.

16. A filter unit according to claim 15, characterized in that the number of ventilating openings provided, and the cross section thereof, is such that initial dilution with ventilating air is between 30 and 70%, preferably between 45 and 55%.

17. A cigarette filter unit, comprising at least one membrane which is in the form of a screen and is arranged in a smoke-gas flow cross section of the unit, the membrane including openings, the spatial distribution and cross sectional areas of the openings being accurately formed as to size and shape, wherein the thickness of the membrane is between 10 and 150 μm, the number of openings in the membrane is between 500 and 25,000, and the cross sectional area of each of the openings is between 80 and 3,000 $\mu m^2$; the unit also including at least one excess flow opening for smoke-gas flow paralleling flow through the membrane and having a cross section at least 10 times larger than that of the largest opening in the membrane; and the unit also including at least one ventilation opening downstream of the membrane in the direction of flow, the ventilation opening extending between the interior and exterior of the filter unit.

* * * * *